US009254034B2

(12) United States Patent
Hsu

(10) Patent No.: US 9,254,034 B2
(45) Date of Patent: Feb. 9, 2016

(54) COMBINATION DINING TURNTABLE THAT IS EXTENDED INFINITELY

(71) Applicant: WELTER'S CO., LTD., Yinlin (TW)

(72) Inventor: Walter W. Hsu, Yinlin (TW)

(73) Assignee: Welter's Co., Ltd., Yinlin (TW)

( * ) Notice: Subject to any disclaimer, the term of this patent is extended or adjusted under 35 U.S.C. 154(b) by 0 days.

(21) Appl. No.: 14/322,971

(22) Filed: Jul. 3, 2014

(65) Prior Publication Data

US 2016/0000218 A1 Jan. 7, 2016

(51) Int. Cl.
*A47B 1/06* (2006.01)
*A47B 13/08* (2006.01)

(52) U.S. Cl.
CPC ..... *A47B 13/081* (2013.01); *A47B 13/088* (2013.01)

(58) Field of Classification Search
CPC ..... A47B 1/08; A47B 1/00; A47B 1/06; A47B 1/10; A47B 1/05; A47B 1/056; A47B 3/04; A47B 3/00; A47B 2087/004; A47B 13/081
USPC ..... 108/68, 66, 67, 73, 65, 63, 64
See application file for complete search history.

(56) References Cited

U.S. PATENT DOCUMENTS

| | | | | | |
|---|---|---|---|---|---|
| 18,636 | A * | 11/1857 | Gross | 108/65 |
| RE3,324 | E * | 3/1869 | Wolfinger | 108/67 |
| 91,974 | A * | 6/1869 | Simensen | 108/66 |
| 606,084 | A * | 6/1898 | Poupon | 108/65 |
| 1,139,564 | A * | 5/1915 | Oberg et al. | 108/66 |
| 1,272,983 | A * | 7/1918 | Menzo | 108/93 |
| 1,756,586 | A * | 4/1930 | Drew | 108/73 |
| 3,267,881 | A * | 8/1966 | Saggione | 108/59 |
| 3,447,491 | A * | 6/1969 | Noren | 108/64 |
| 5,237,937 | A * | 8/1993 | Peltier et al. | 108/66 |
| 6,994,032 | B2 * | 2/2006 | Conley et al. | 108/65 |
| 7,311,047 | B2 * | 12/2007 | Conley et al. | 108/65 |
| 7,849,803 | B2 * | 12/2010 | Conley | 108/65 |
| 8,814,110 | B2 * | 8/2014 | Crager et al. | 108/64 |
| 2009/0232632 | A1 * | 9/2009 | Baltz | 108/64 |

* cited by examiner

*Primary Examiner* — Jose V Chen
(74) *Attorney, Agent, or Firm* — Alan D. Kamrath; Kamrath IP Lawfirm, P.A.

(57) ABSTRACT

A combination dining turntable includes a base unit (10) and a rotary unit (20) mounted on the base unit. The base unit has an endless shape and includes a plurality of connecting plates (11) connected with each other and with each having a rectangular or sector shape. Each of the connecting plates has a first end provided with at least one first connecting portion (13) and a second end provided with at least one second connecting portion (14). The rotary unit has an endless shape and includes a plurality of curved connecting pieces (21) connected with each other. Each of the connecting pieces has a first side provided with at least one first linking portion (22) and a second side provided with at least one second linking portion (23).

5 Claims, 13 Drawing Sheets

COMBINATION DINING TURNTABLE THAT IS EXTENDED INFINITELY

BACKGROUND OF THE INVENTION

1. Field of the Invention

The present invention relates to a piece of dining furniture and, more particularly, to a combination dining turntable.

2. Description of the Related Art

A conventional dining turntable is mounted on a table for placing food dishes. When in use, the dining turntable is rotatable on the table so that the dishes placed on the dining turntable are swivelable relative to the table, and the users can pick the dishes by turning the dining turntable without having to leave the seats. The dining turntable usually has a circular shape to fit a circular table. However, the shape of the conventional dining turntable is fixed and cannot be adjusted to fit tables of different shapes. In addition, the size of the conventional dining turntable is fixed and cannot be adjusted to fit tables of different sizes, thereby limiting the versatility of the conventional dining turntable.

BRIEF SUMMARY OF THE INVENTION

The primary objective of the present invention is to provide a combination dining turntable that is extended infinitely.

In accordance with the present invention, there is provided a combination dining turntable comprising a base unit and a rotary unit mounted on the base unit. The base unit has an endless shape and includes a plurality of connecting plates connected with each other and each having a rectangular or sector shape. Each of the connecting plates is provided with at least one track and has a first end provided with at least one first connecting portion and a second end provided with at least one second connecting portion. The first connecting portion of one of the connecting plates is connected with the second connecting portion of another one of the connecting plates to combine the connecting plates together. The rotary unit has an endless shape and includes a plurality of curved connecting pieces connected with each other. Each of the connecting pieces is provided with at least one roller slidable in the track of each of the connecting plates and has a first side provided with at least one first linking portion and a second side provided with at least one second linking portion. The first linking portion of one of the connecting pieces is connected with the second linking portion of another one of the connecting pieces to combine the connecting pieces together.

According to the primary advantage of the present invention, the connecting plates are connected successively to form the base unit, and the connecting pieces are connected successively to form the rotary unit, so that the base unit and the rotary unit are extended infinitely and are available for dining tables of different sizes.

According to another advantage of the present invention, the configuration of the base unit and the rotary unit can be changed to fit the shape of a dining table, so that the base unit and the rotary unit are available for dining tables of different profiles, thereby enhancing the versatility of the combination dining turntable.

According to a further advantage of the present invention, when the connecting pieces are moved relative to the base unit, the first engaging portion of one of the connecting pieces engages the second engaging portion of another one of the connecting pieces so that the connecting pieces of the rotary unit are juxtaposed to each other stably and are moved on the base unit without incurring deflection during movement.

According to a further advantage of the present invention, the connecting pieces of the rotary unit are moved on the connecting plates of the base unit easily and smoothly by guidance of the roller of each of the connecting pieces in the track of each of the connecting plates so that when any one of the connecting pieces is pushed, the rotary unit is moved and rotated on the base unit easily and conveniently.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
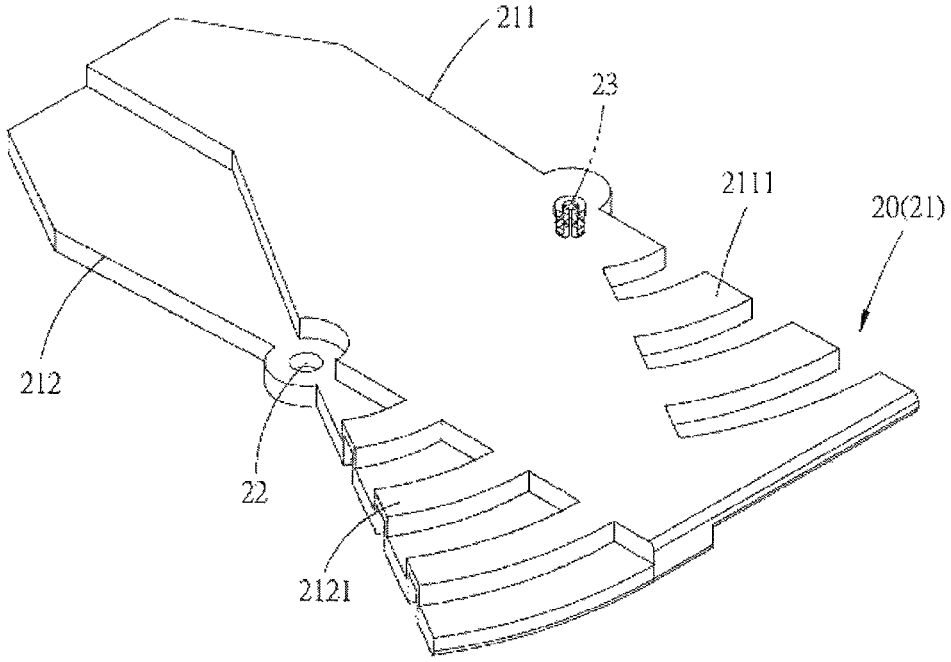
FIG. 1 is a perspective view of a connecting piece of a combination dining turntable in accordance with the preferred embodiment of the present invention.
Figure 2:
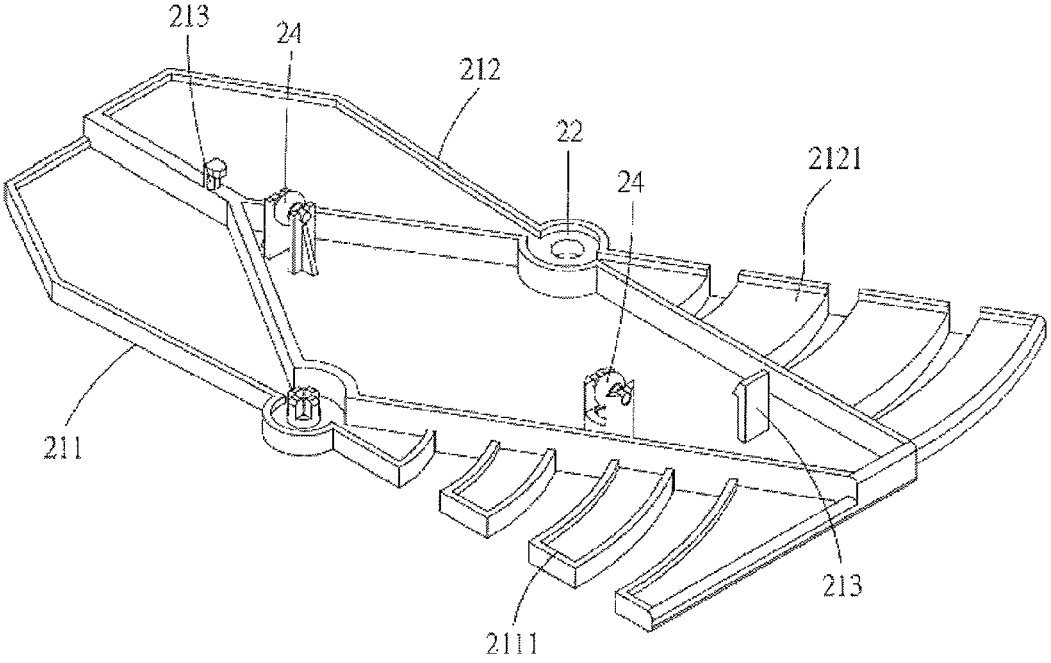
FIG. 2 is a bottom perspective view of the connecting piece of the combination dining turntable as shown in FIG. 1.
Figure 3:
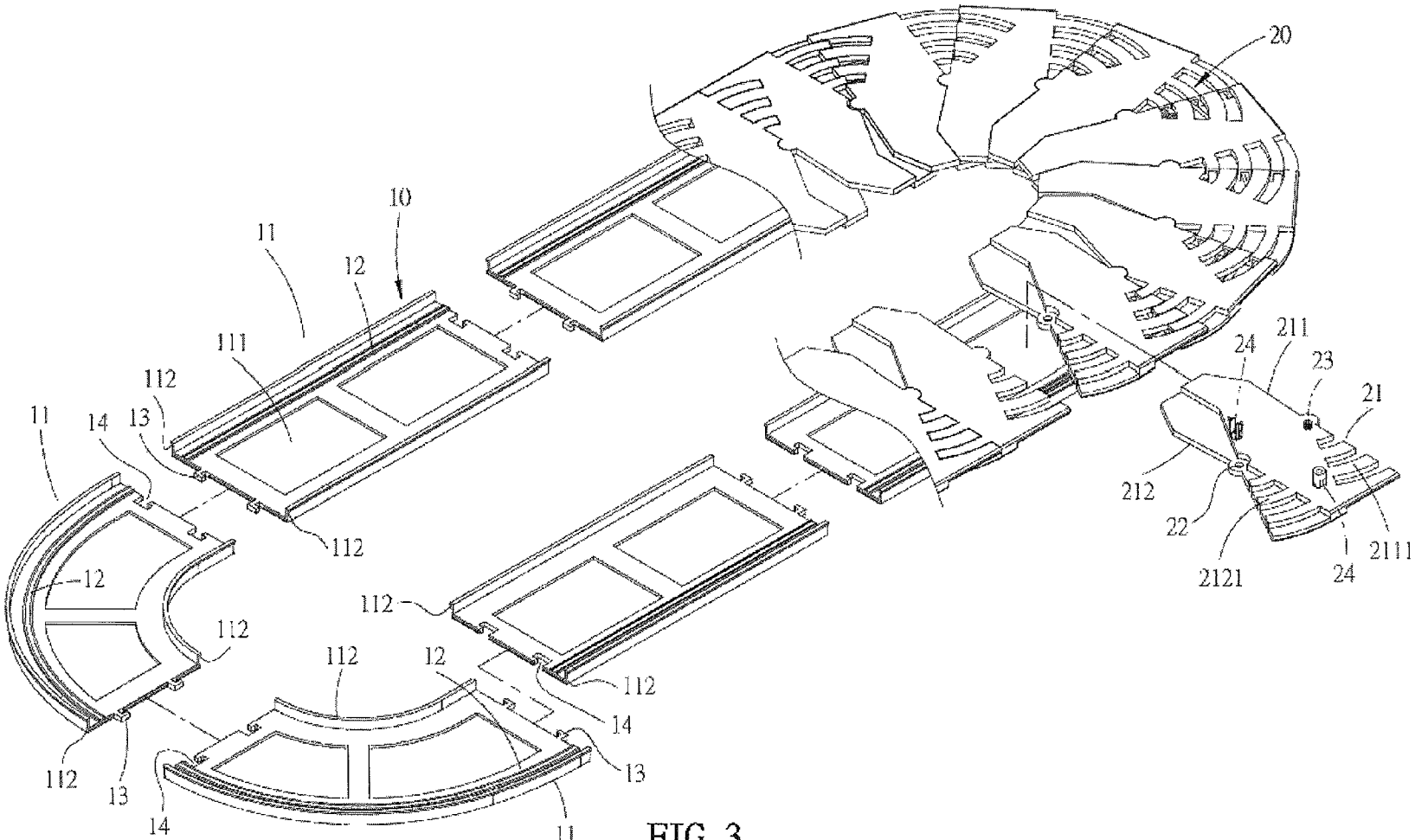
FIG. 3 is a partially exploded perspective view of a combination dining turntable in accordance with the preferred embodiment of the present invention.

Referring to the drawings and initially to FIGS. 1-4, a combination dining turntable in accordance with the preferred embodiment of the present invention comprises a base unit 10 and a rotary unit 20 mounted on the base unit 10.

The base unit 10 has an endless shape and includes a plurality of connecting plates 11 connected with each other and each having a rectangular or sector shape. Each of the connecting plates 11 is provided with at least one track 12 and has a first end provided with at least one first connecting portion 13 and a second end provided with at least one second connecting portion 14. The first connecting portion 13 of one of the connecting plates 11 is connected with the second connecting portion 14 of another one of the connecting plates 11 to combine the connecting plates 11 together. Each of the connecting plates 11 is provided with two guide rails 112 formed two opposite sides thereof. Each of the connecting plates 11 has a face provided with at least one opening 111.

The rotary unit 20 has an endless shape and includes a plurality of curved connecting pieces 21 connected with each other. Each of the connecting pieces 21 is provided with at least one roller 24 slidable in the track 12 of each of the connecting plates 11 and has a first side provided with at least one first linking portion 22 and a second side provided with at least one second linking portion 23. The first linking portion 22 of one of the connecting pieces 21 is connected with the second linking portion 23 of another one of the connecting pieces 21 to combine the connecting pieces 21 together. Each of the connecting pieces 21 is provided with two slide blocks 213 slidable on the guide rails 112 of each of the connecting plates 11. Each of the connecting pieces 21 has a stepped shape and has a first surface 211 provided with a first engaging portion 2111 and a second surface 212 lower than the first surface 211 and provided with a second engaging portion 2121. Preferably, the first engaging portion 2111 of each of the connecting pieces 21 is formed on an end of the first surface 211, and the second engaging portion 2121 of each of the connecting pieces 21 is formed on an end of the second surface 212. The first engaging portion 2111 of one of the connecting pieces 21 engages the second engaging portion 2121 of another one of the connecting pieces 21. The first engaging portion 2111 and the second engaging portion 2121 of each of the connecting pieces 21 are arranged in a staggered manner and have a toothed rack shape.

Figure 4:
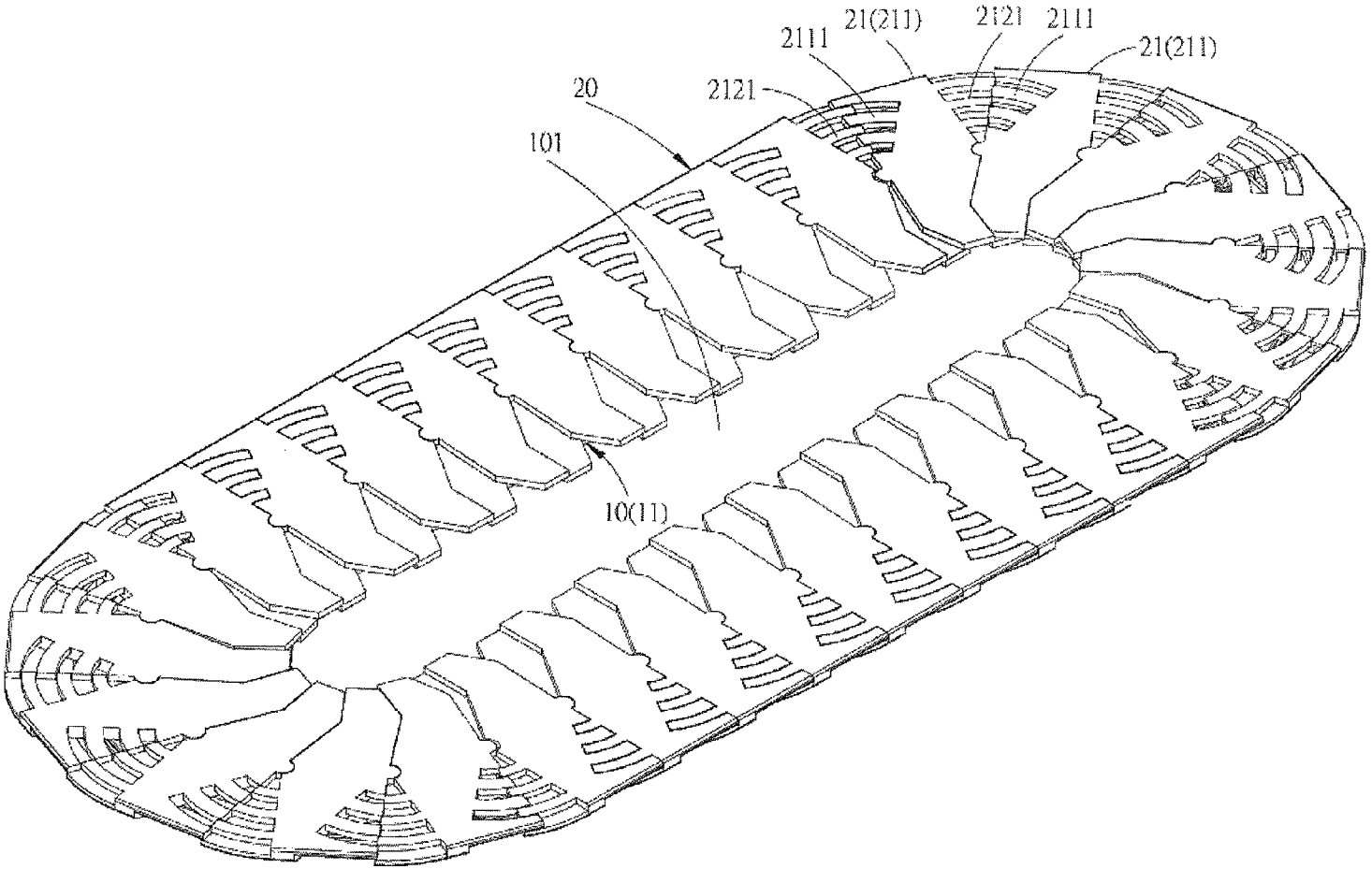
FIG. 4 is a perspective assembly view of the combination dining turntable as shown in FIG. 3.

In assembly, the first connecting portion 13 of one of the connecting plates 11 is connected with the second connecting portion 14 of another one of the connecting plates 11 so that the connecting plates 11 are in turn connected together to construct the base unit 10 which has an endless shape. Then, the connecting pieces 21 are placed on the connecting plates 11 of the base unit 10, with the first linking portion 22 of one of the connecting pieces 21 being connected with the second linking portion 23 of another one of the connecting pieces 21 so that the connecting pieces 21 are connected together to construct the rotary unit 20 which has an endless shape as shown in FIG. 4. At this time, the first engaging portion 2111 of one of the connecting pieces 21 engages the second engaging portion 2121 of another one of the connecting pieces 21 so that the connecting pieces 21 of the rotary unit 20 are juxtaposed to each other solidly and stably and are moved on the connecting plates 11 of the base unit 10 without deflection. Thus, the rotary unit 20 is combined with the base unit 10 to construct the combination dining turntable. At this time, the roller 24 of each of the connecting pieces 21 is slidable in the track 12 of each of the connecting plates 11 so that the connecting pieces 21 of the rotary unit 20 are moved on the connecting plates 11 of the base unit 10 smoothly and stably. Thus, when any one of the connecting pieces 21 of the rotary unit 20 is pushed, the rotary unit 20 is moved and rotated on the base unit 10.

As shown in FIG. 4, the base unit 10 and the rotary unit 20 have an elongate oblong shape.

Figure 5:
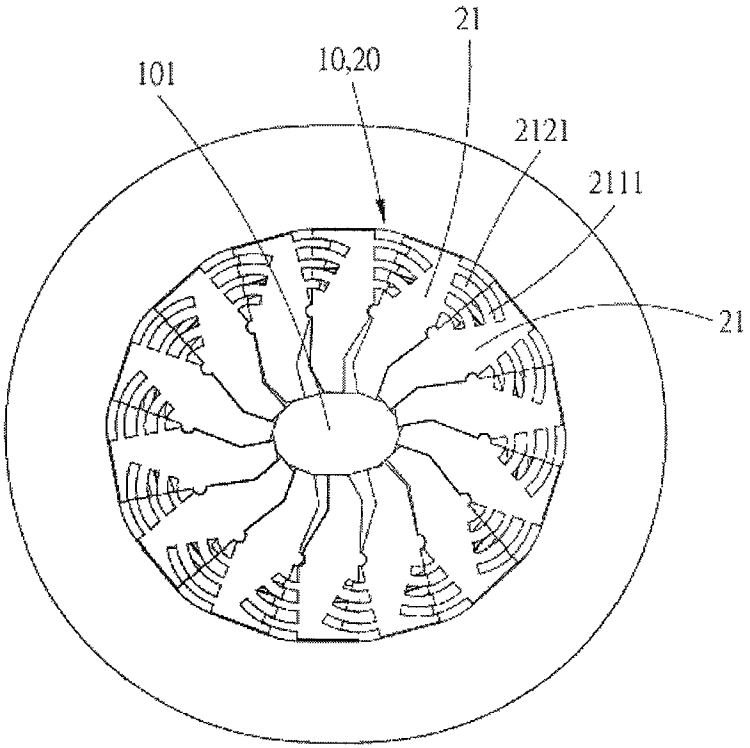
FIG. 5 is a top view of a combination dining turntable in accordance with another preferred embodiment of the present invention.

As shown in FIG. 5, the base unit 10 and the rotary unit 20 have a circular shape.

Figure 6:
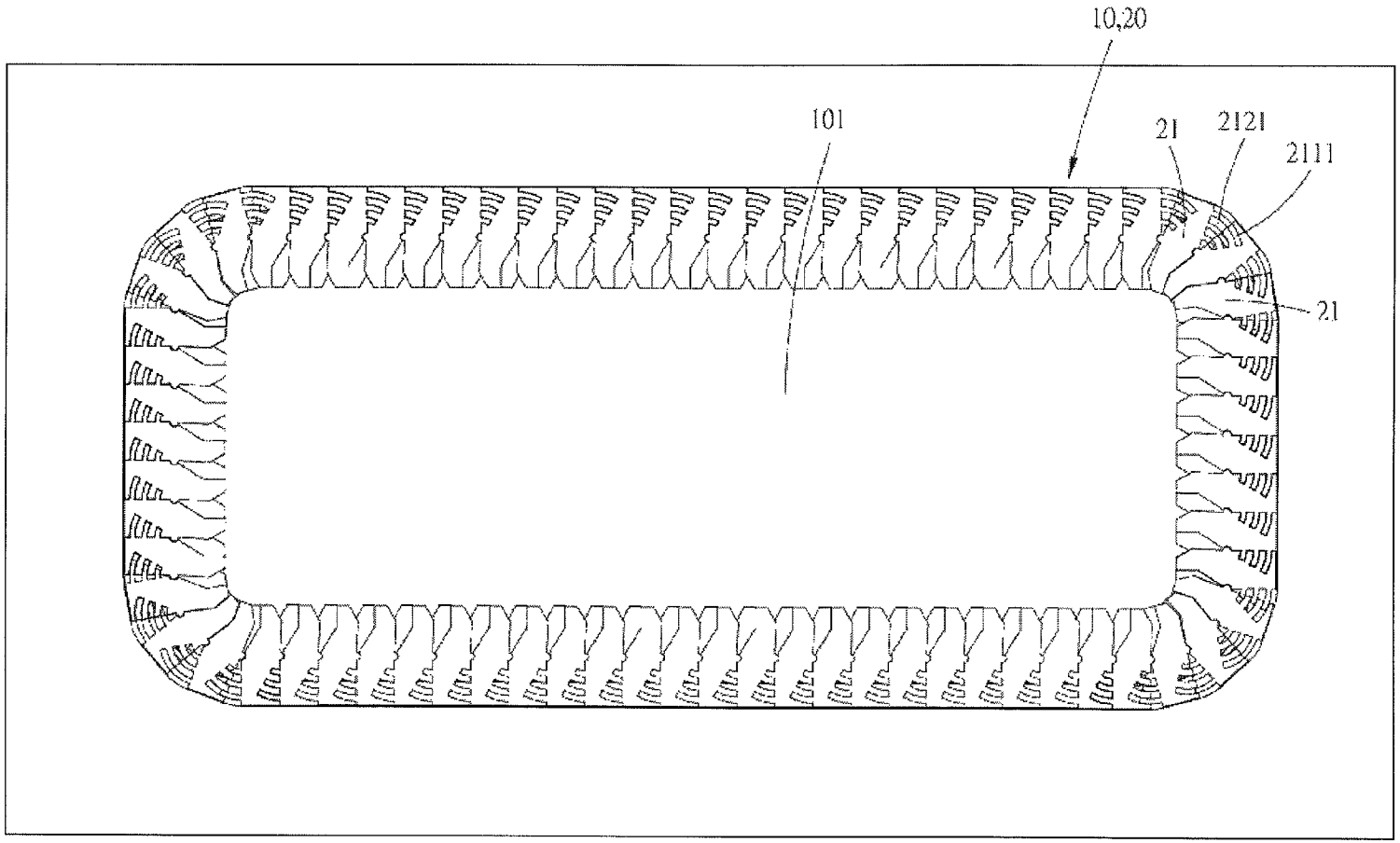
FIG. 6 is a top view of a combination dining turntable in accordance with another preferred embodiment of the present invention.

As shown in FIG. 6, the base unit 10 and the rotary unit 20 have a rectangular shape.

Accordingly, the connecting plates 11 are connected successively to form the base unit 10, and the connecting pieces 21 are connected successively to form the rotary unit 20, so that the base unit 10 and the rotary unit 20 are extended infinitely and are available for dining tables of different sizes. In addition, the configuration of the base unit 10 and the rotary unit 20 can be changed to fit the shape of a dining table, so that the base unit 10 and the rotary unit 20 are available for dining tables of different profiles, thereby enhancing the versatility of the combination dining turntable. Further, when the connecting pieces 21 are moved relative to the base unit 10, the first engaging portion 2111 of one of the connecting pieces 21 engages the second engaging portion 2121 of another one of the connecting pieces 21 so that the connecting pieces 21 of the rotary unit 20 are juxtaposed to each other stably and are moved on the base unit 10 without incurring deflection during movement. Further, the connecting pieces 21 of the rotary unit 20 are moved on the connecting plates 11 of the base unit 10 easily and smoothly by guidance of the roller 24 of each of the connecting pieces 21 in the track 12 of each of the connecting plates 11 so that when any one of the connecting pieces 21 is pushed, the rotary unit 20 is moved and rotated on the base unit 10 easily and conveniently.

Figure 7:
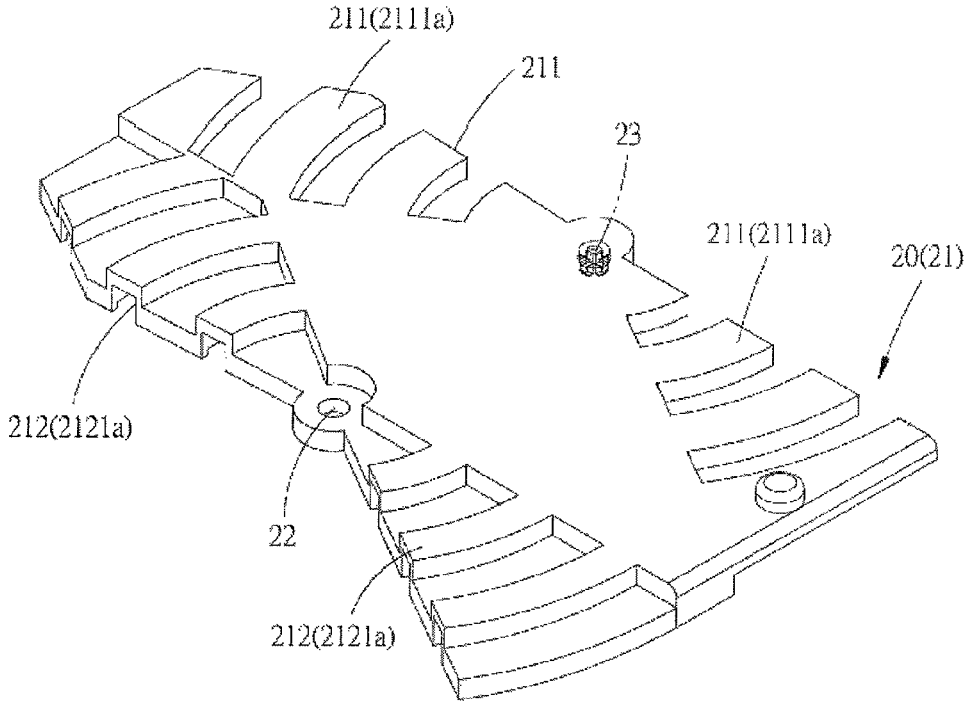
FIG. 7 is a perspective view of a connecting piece of a combination dining turntable in accordance with another preferred embodiment of the present invention.
Figure 8:
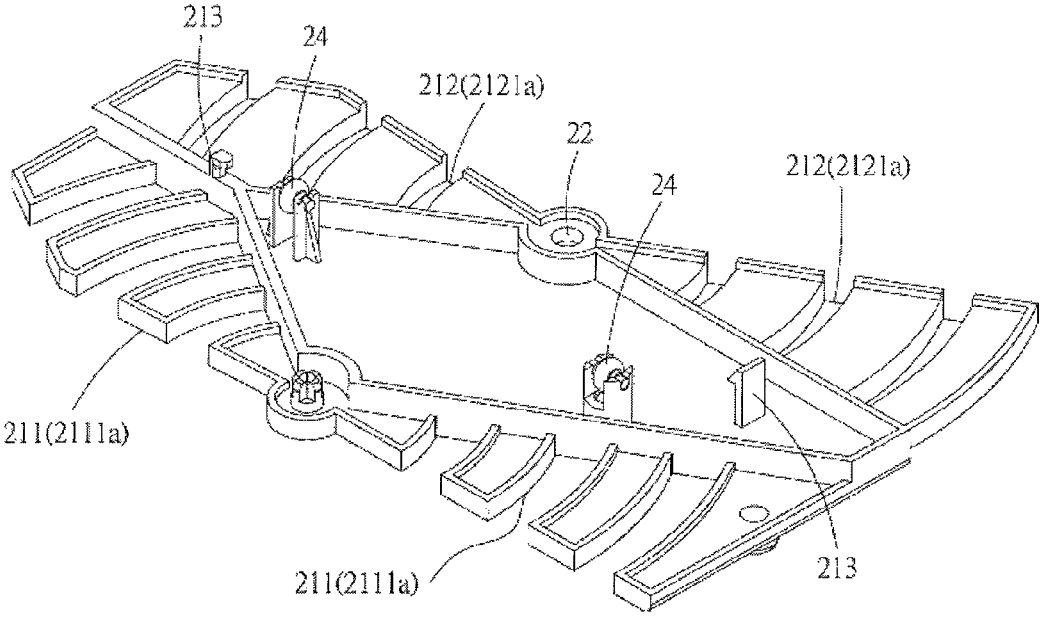
FIG. 8 is a bottom perspective view of the connecting piece of the combination dining turntable as shown in FIG. 7.
Figure 9:
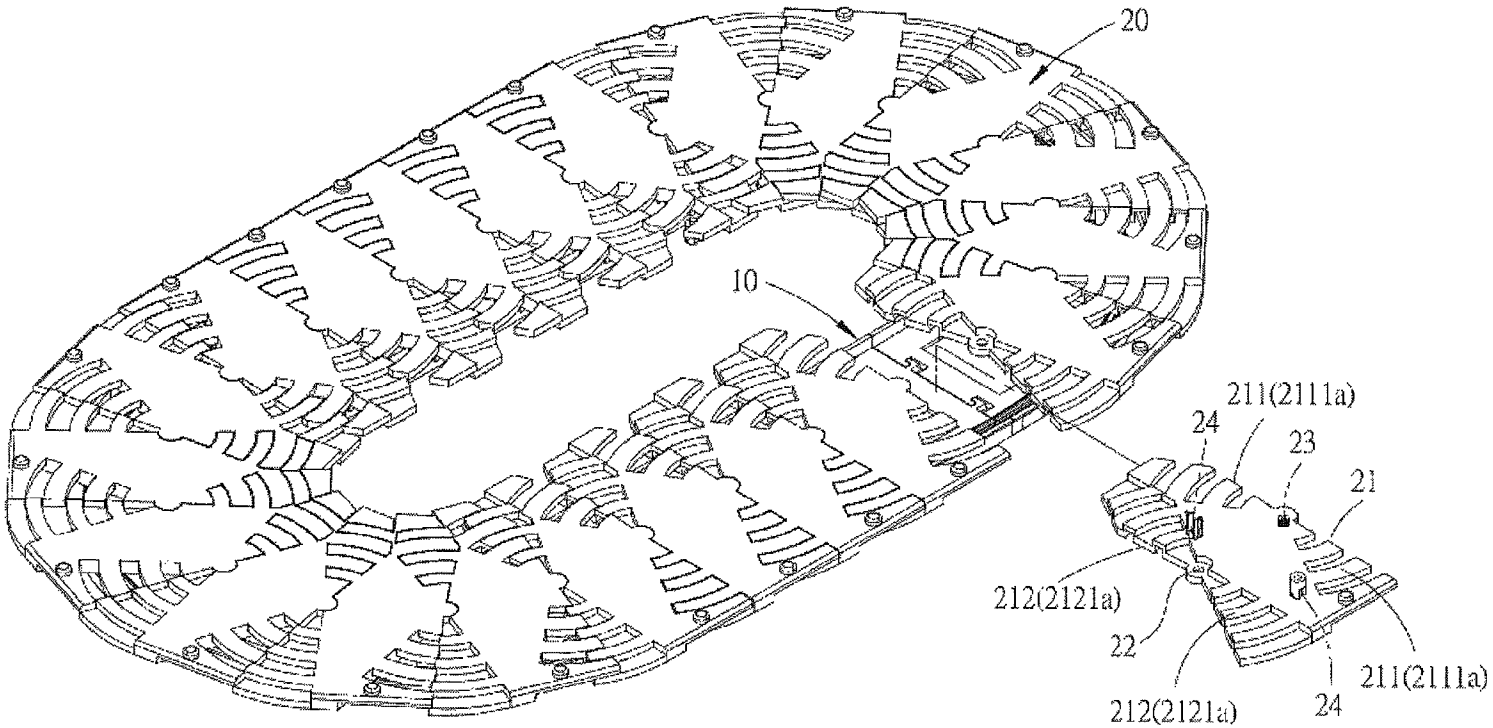
FIG. 9 is a partially exploded perspective view of a combination dining turntable in accordance with another preferred embodiment of the present invention.

Referring to FIGS. 7-9, the first engaging portion 2111*a* of each of the connecting pieces 21 is formed on two opposite ends of the first surface 211, and the second engaging portion 2121*a* of each of the connecting pieces 21 is formed on two opposite ends of the second surface 212.

Figure 10:
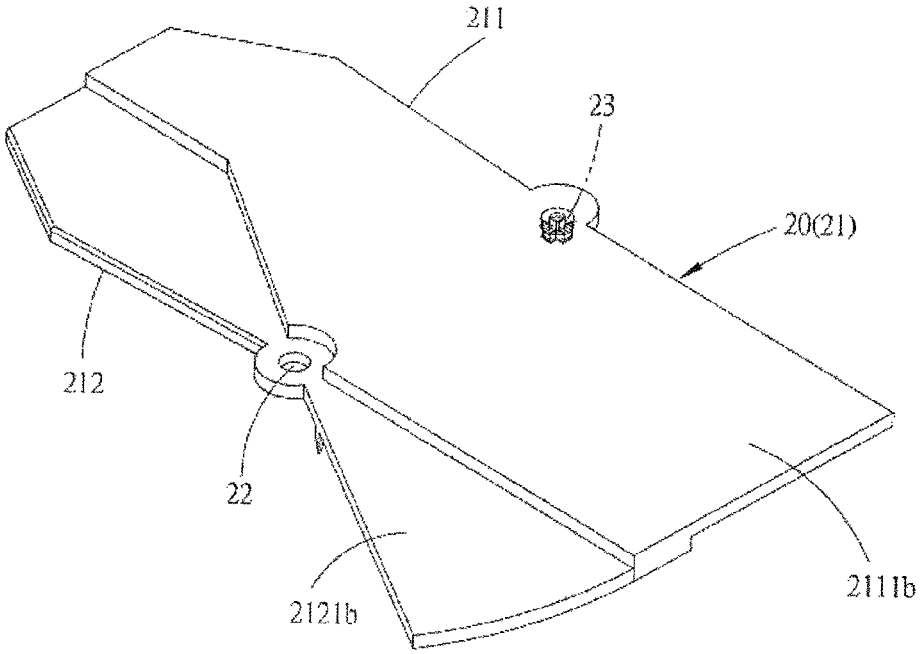
FIG. 10 is a perspective view of a connecting piece of a combination dining turntable in accordance with another preferred embodiment of the present invention.
Figure 11:
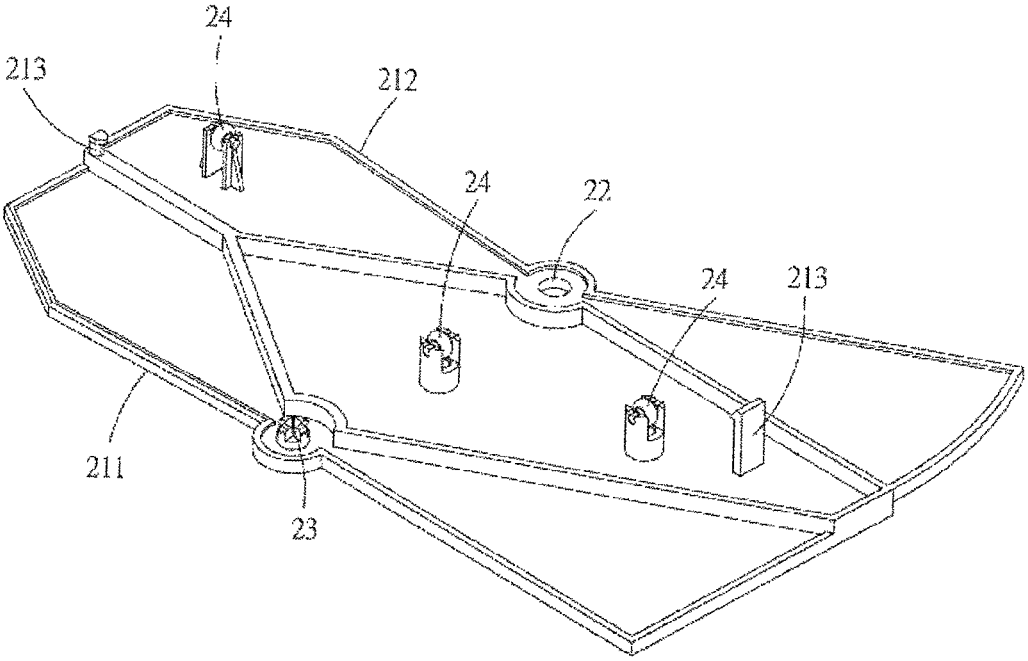
FIG. 11 is a bottom perspective view of the connecting piece of the combination dining turntable as shown in FIG. 10.

Referring to FIGS. 10 and 11, the first engaging portion 2111*b* of each of the connecting pieces 21 is a flat face, and the second engaging portion 2121*b* of each of the connecting pieces 21 is a flat face and is lower than the first engaging portion 2111*b*.

Referring to FIGS. 12-16, the combination dining turntable further comprises a transmission unit 30 connected with the base unit 10.

The base unit 10 has a bottom provided with a plurality of C-shaped first locking grooves 114 and a plurality of connecting slots 115. The base unit 10 has a central hole 101 which has two opposite sides each provided with a positioning hole 113. Each of the connecting pieces 21 of the rotary unit 20 has a bottom provided with a toothed rack 25.

The transmission unit 30 includes a connecting board 31 mounted in the central hole 101 of the base unit 10, and two driving mechanisms 32 mounted on the connecting board 31.

The connecting board 31 has a substantially inverted U-shaped profile and has a face provided with a receiving hole 311 and two opposite side plates 312. The two side plates 312 of the connecting board 31 extend vertically and downward. The connecting board 31 has two opposite ends each provided with a positioning block 315 mounted in the positioning hole 113 of the base unit 10. The connecting board 31 is provided with a plurality of elastic legs 313 each having a distal end provided with a positioning hook 3131 locked in one of the connecting slots 115 of the base unit 10. The elastic legs 313 extend outward from four corners of the connecting board 31 and are received in the connecting slots 115 of the base unit 10. Each of the elastic legs 313 has a side provided with an arcuate pressing block 3132. The connecting board 31 has a bottom provided with a plurality of C-shaped second locking grooves 314.

Figure 12:
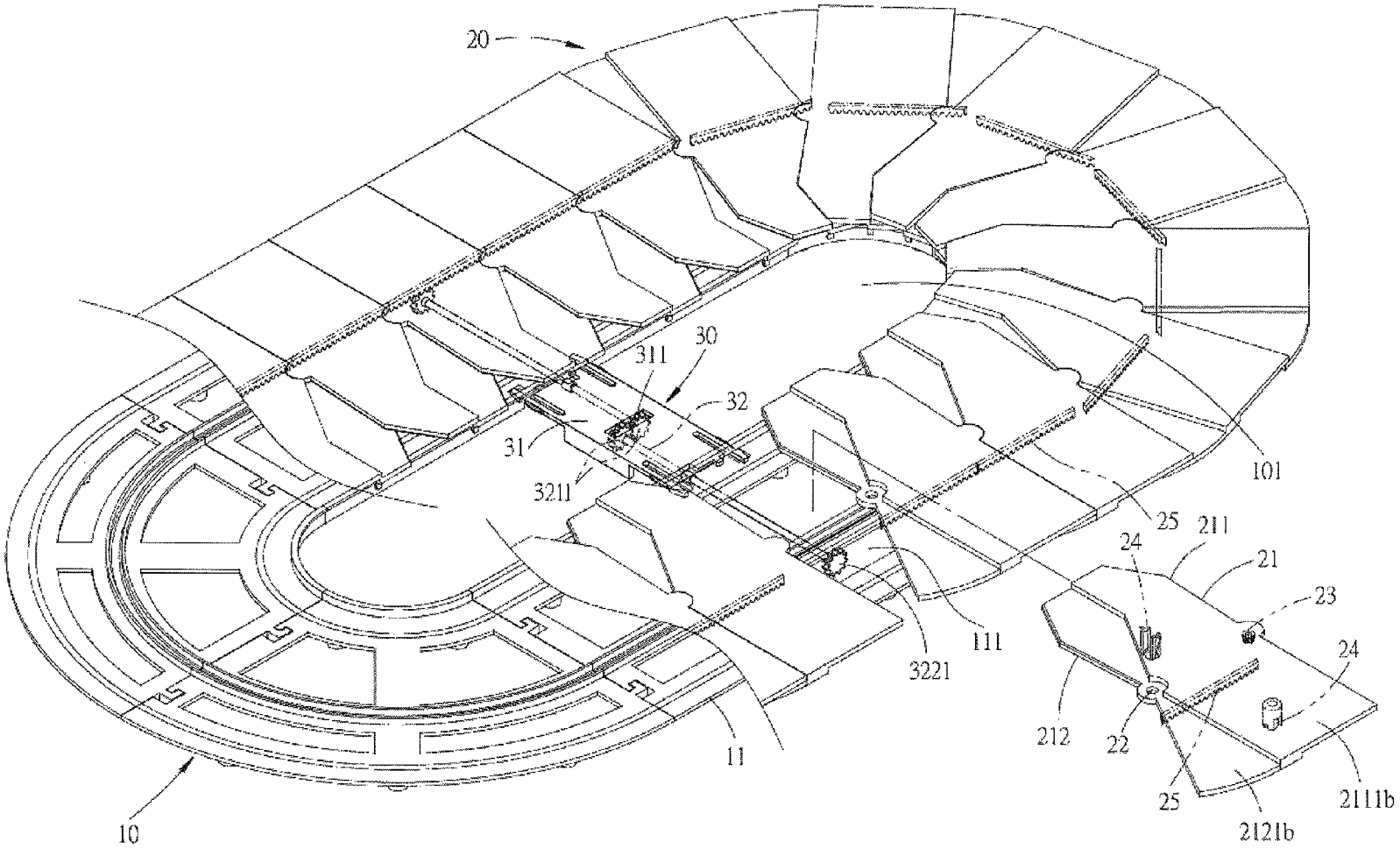
FIG. 12 is a partially exploded perspective view of a combination dining turntable in accordance with another preferred embodiment of the present invention.
Figure 13:
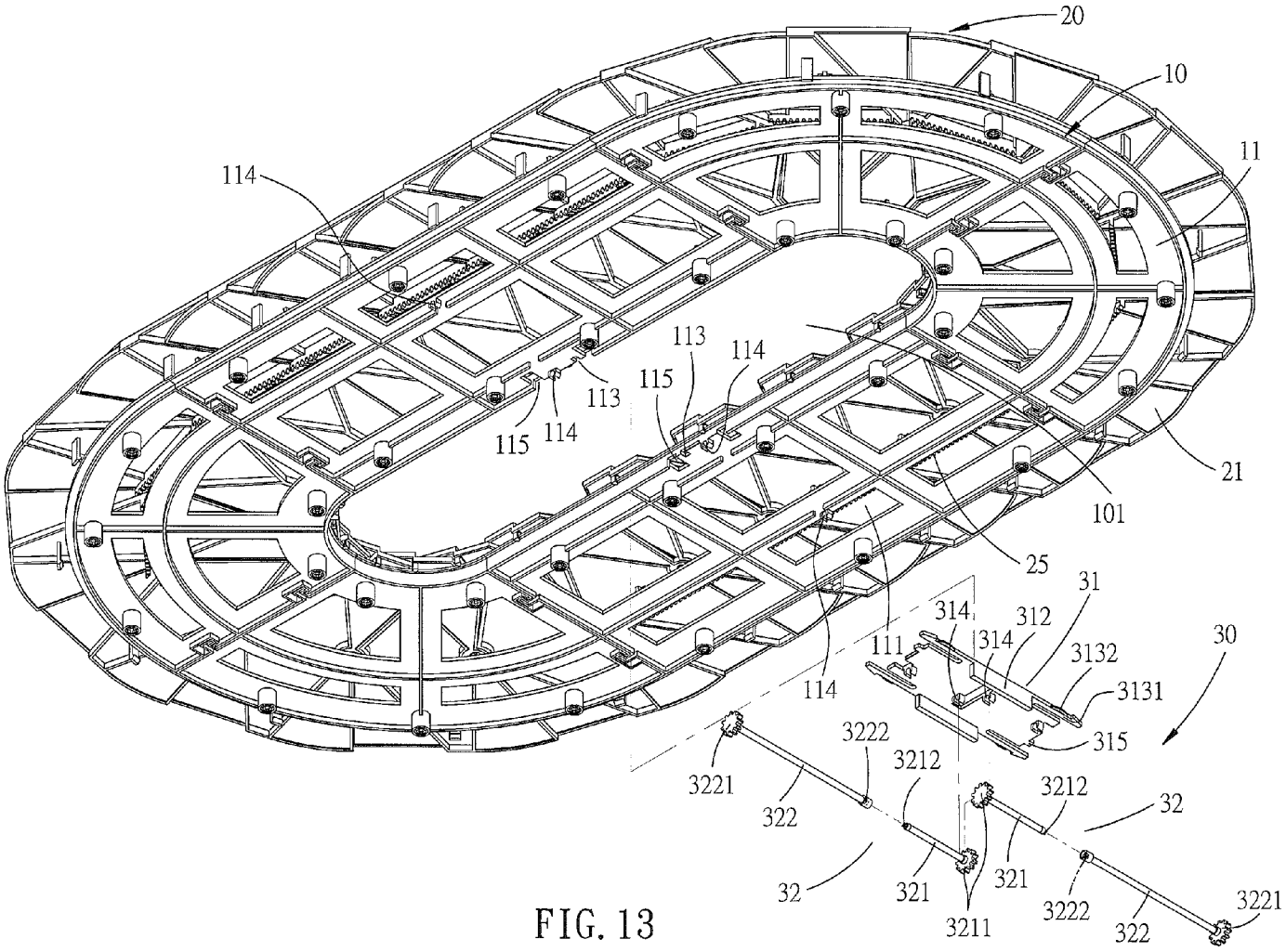
FIG. 13 is a partially bottom exploded perspective view of the combination dining turntable as shown in FIG. 12.
Figure 14:
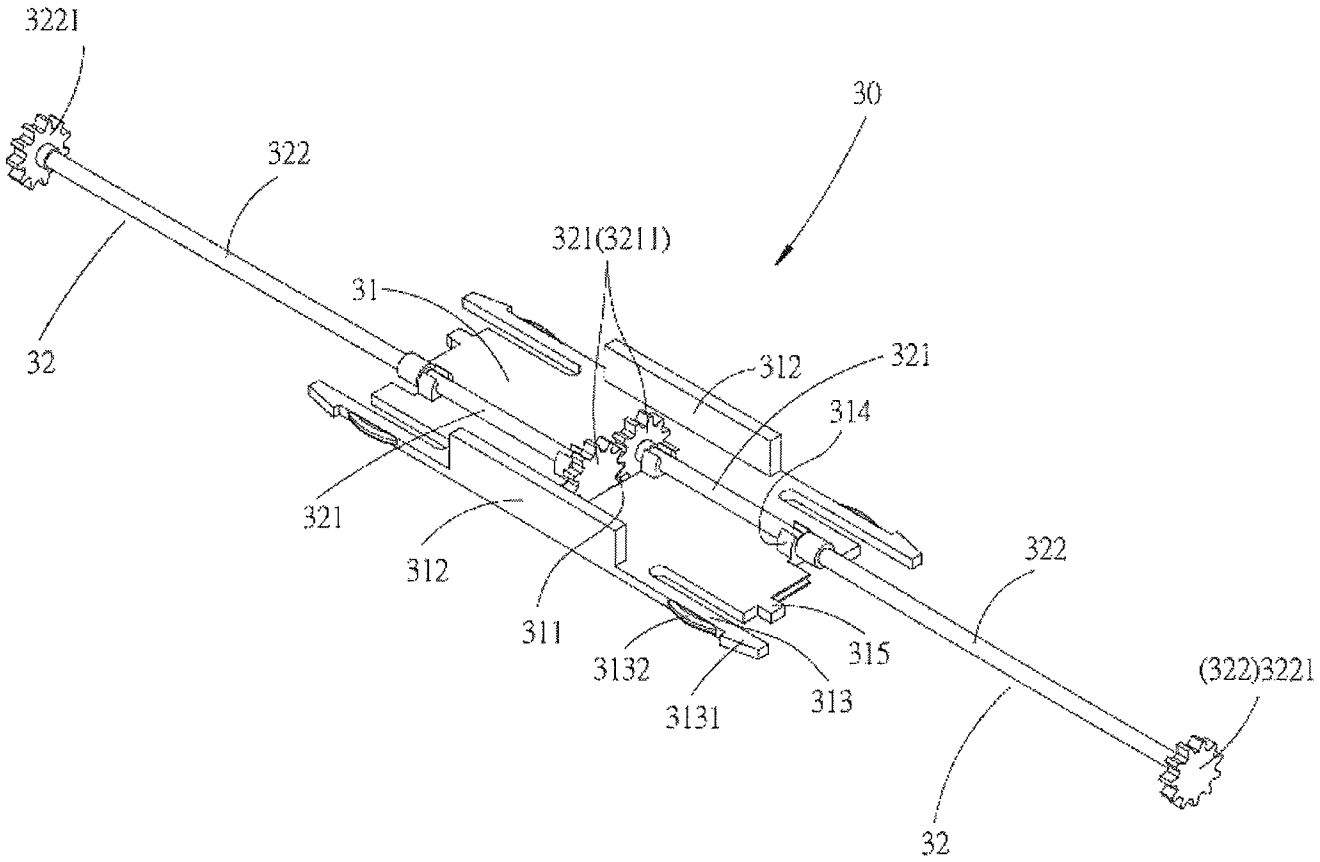
FIG. 14 is a perspective view of a transmission unit of the combination dining turntable as shown in FIG. 12.
Figure 15:
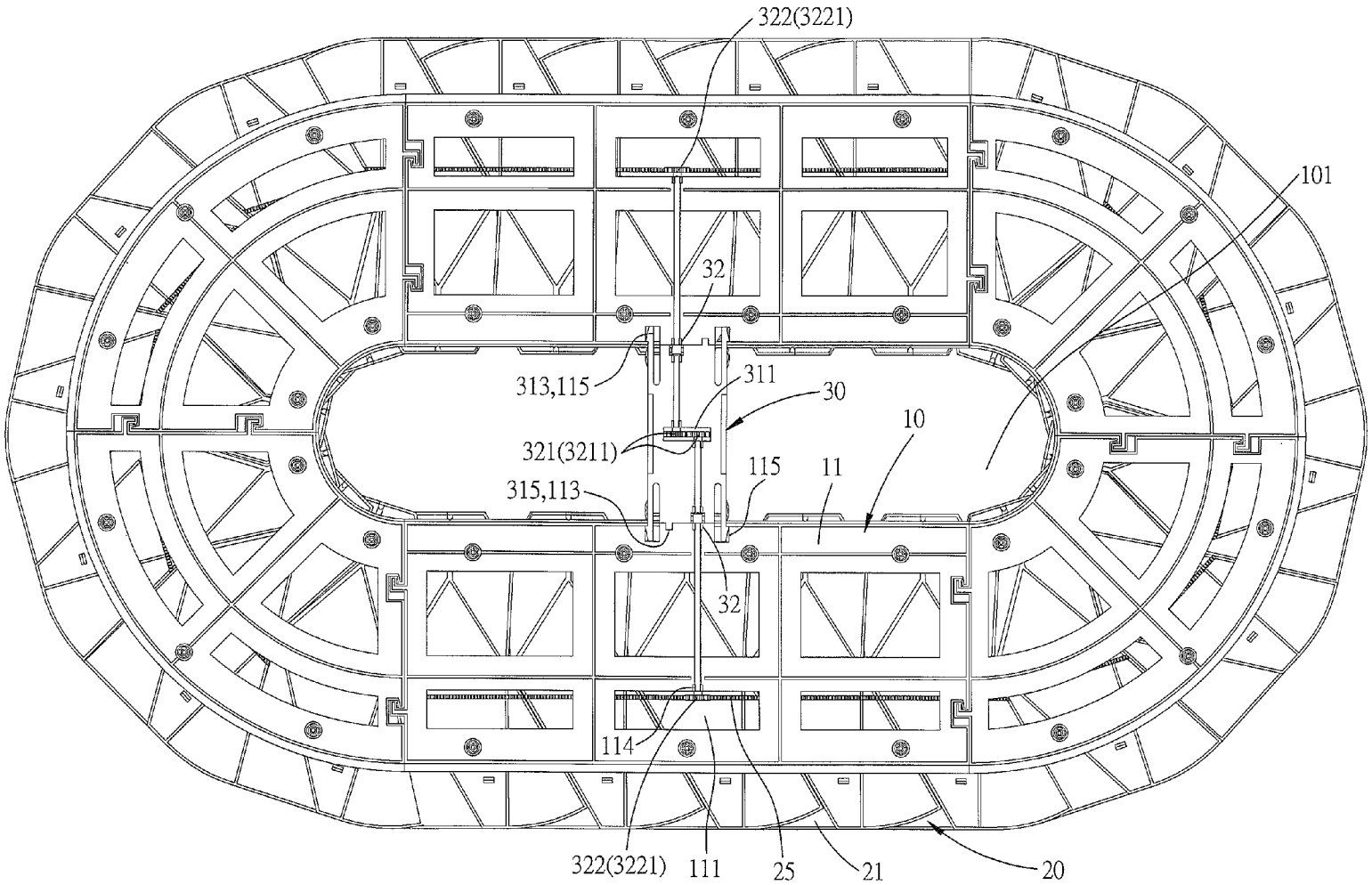
FIG. 15 is a bottom assembly view of the combination dining turntable as shown in FIG. 13.

The driving mechanisms 32 are locked by the first locking grooves 114 of the base unit 10 and the second locking grooves 314 of the connecting board 31. Each of the driving mechanisms 32 includes a first rod 321 and a second rod 322 connected with and longer than the first rod 321. The first rod 321 is locked by the second locking grooves 314 of the connecting board 31 and has a first end provided with a first gear 3211 and a second end provided with a mounting section 3212 having a cruciform shape. The first gears 3211 of the driving mechanisms 32 mesh with each other and are received in the receiving hole 311 of the connecting board 31. The second rod 322 is locked by the first locking grooves 114 of the base unit 10 and has a first end provided with a second gear 3221 and a second end provided with a mounting hole 3222 having a cruciform shape and mounted on the mounting section 3212 of the first rod 321. The second gear 3221 of each of the driving mechanisms 32 is exposed from the opening 111 of one of the connecting plates 11 and meshes with the toothed rack 25 of each of the connecting pieces 21 as shown in FIG. 12.

Figure 16:
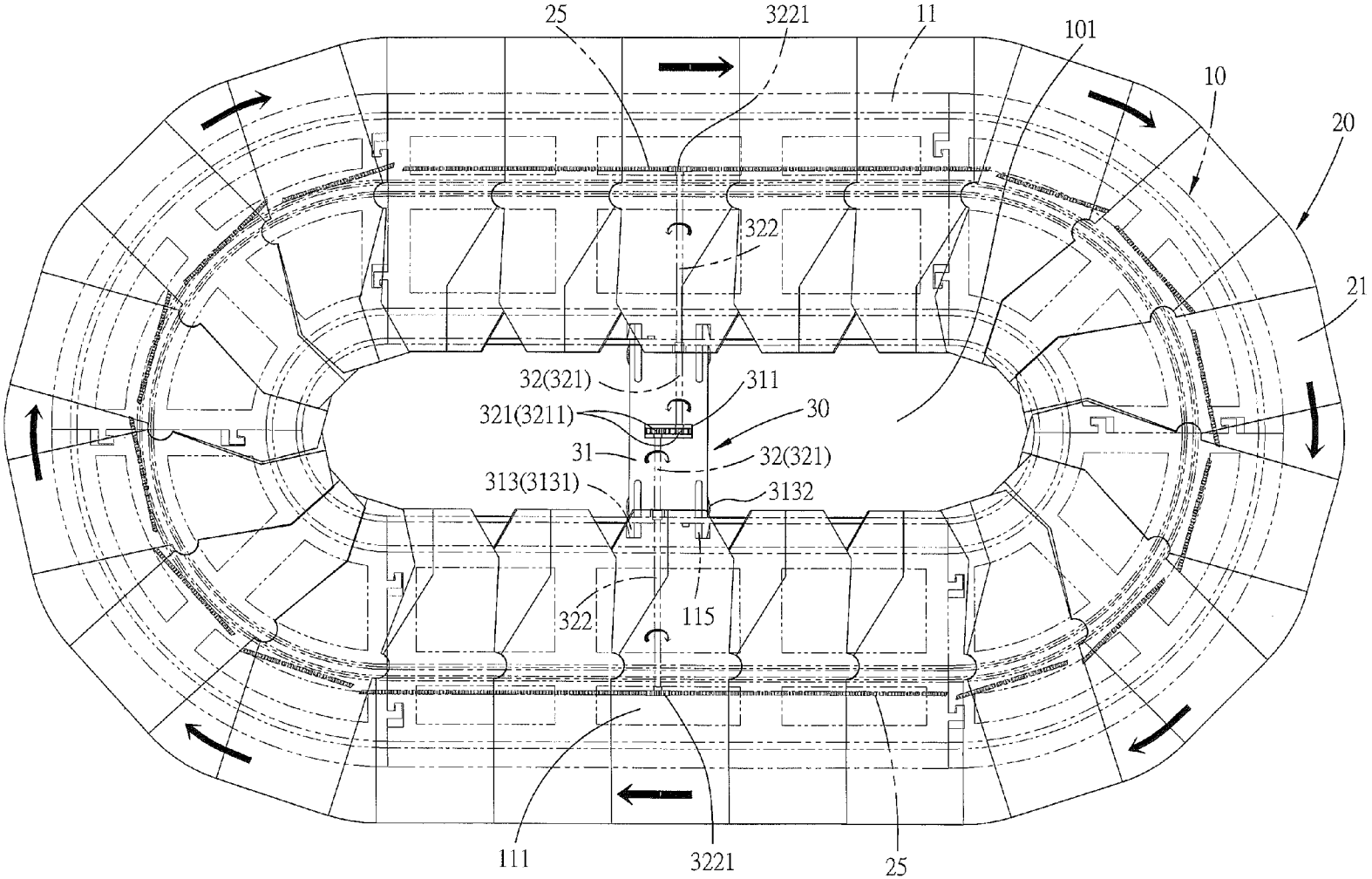
FIG. 16 is a top operational view of the combination dining turntable as shown in FIG. 15.

In operation, referring to FIG. 16 with reference to FIGS. 12-15, when the transmission unit 30 is driven by a driver, such as a motor and the like, the driving mechanisms 32 are rotated, and the second gear 3221 of each of the driving mechanisms 32 is rotated to move the toothed rack 25 of each of the connecting pieces 21 so that each of the connecting pieces 21 is moved relative to the base unit 10. Thus, the rotary unit 20 is driven by the transmission unit 30 to rotate relative to the base unit 10 in a single direction as shown in FIG. 16.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A combination dining turntable comprising:

a base unit; and a rotary unit mounted on the base unit;

wherein:

the base unit has an endless shape and includes a plurality of connecting plates connected with each other and each having a rectangular or sector shape;

each of the plurality of connecting plates is provided with at least one track and has a first end provided with at least one first connecting portion and a second end provided with at least one second connecting portion;

the first connecting portion of one of the plurality of connecting plates is connected with the second connecting portion of another one of the plurality of connecting plates to combine the plurality of connecting plates together;

the rotary unit has an endless shape and includes a plurality of curved connecting pieces connected with each other;

each of the plurality of connecting pieces is provided with at least one roller mounted thereon and slidable in the at least one track of each of the plurality of connecting plates for moving each of the plurality of connecting pieces on each of the plurality of connecting plates, wherein each of the plurality of connecting pieces has a first side provided with at least one first linking portion and a second side provided with at least one second linking portion; and the first linking portion of one of the plurality of connecting pieces is connected with the second linking portion of another one of the plurality of connecting pieces to combine the plurality of connecting pieces together.

2. The combination dining turntable of claim 1, wherein:

each of the plurality of connecting plates is provided with two guide rails formed two opposite sides thereof;

each of the plurality of connecting pieces is provided with two slide blocks slidable in the two guide rails of each of the plurality of connecting plates; and each of the plurality of connecting pieces has a first surface provided with a first engaging portion and a second surface provided with a second engaging portion.

3. The combination dining turntable of claim 2, wherein:

the first engaging portion of one of the plurality of connecting pieces engages the second engaging portion of another one of the plurality of connecting pieces;

the first engaging portion and the second engaging portion of each of the plurality of connecting pieces have a toothed rack shape;

the first engaging portion of each of the plurality of connecting pieces is formed on an end or two opposite ends of the first surface; and the second engaging portion of each of the plurality of connecting pieces is formed on an end or two opposite ends of the second surface.

4. The combination dining turntable of claim 3, wherein the first engaging portion of each of the plurality of connecting pieces is a flat face, and the second engaging portion of each of the plurality of connecting pieces is a flat face.

5. The combination dining turntable of claim 1, further comprising a transmission unit connected with the base unit; wherein:

the base unit has a bottom provided with a plurality of first locking grooves and a plurality of connecting slots;

the base unit has a central hole which has two opposite sides each provided with a positioning hole;

each of the plurality of connecting pieces of the rotary unit has a bottom provided with a toothed rack;

the transmission unit includes:

a connecting board mounted in the central hole of the base unit; and two driving mechanisms mounted on the connecting board;

the connecting board has a face provided with a receiving hole and two opposite side plates;

the connecting board has two opposite ends each provided with a positioning block mounted in the positioning hole of the base unit;

the connecting board is provided with a plurality of elastic legs each having a distal end provided with a positioning hook locked in one of the plurality of connecting slots of the base unit;

each of the plurality of elastic legs has a side provided with an arcuate pressing block;

the connecting board has a bottom provided with a plurality of second locking grooves;

the two driving mechanisms are rotatably mounted by being locked in the plurality of first locking grooves of the base unit and the plurality of second locking grooves of the connecting board;

each of the two driving mechanisms includes:

a first rod; and a second rod connected with the first rod;

the first rod has a first end provided with a first gear and a second end provided with a mounting section;

the first gears of the two driving mechanisms mesh with each other and are received in the receiving hole of the connecting board;

the second rod has a first end provided with a second gear and a second end provided with a mounting hole mounted on the mounting section of the first rod; and the second gear of each of the two driving mechanisms meshes with the toothed rack of each of the plurality of connecting pieces.

* * * * *